United States Patent [19]

Cassanas et al.

[11] Patent Number: 4,492,164

[45] Date of Patent: Jan. 8, 1985

[54] PRINTER WITH INKER ON THE PLATEN ROLLER

[75] Inventors: Claude Cassanas, Boussy St Antoine; Jean-Pierre Couot, Brie Comte Robert; Jacques Royer, Maisons Alfort, all of France

[73] Assignee: U.S. Philips Corporation, New York, N.Y.

[21] Appl. No.: 469,537

[22] Filed: Feb. 24, 1983

[30] Foreign Application Priority Data

Feb. 26, 1982 [FR] France ..... 82 03235

[51] Int. Cl.[3] ..... B41K 3/32; B41K 3/56; B41K 3/62

[52] U.S. Cl. ..... 101/216; 101/328; 101/232; 101/335

[58] Field of Search ..... 101/328, 329, 332, 216, 101/232, 335

[56] References Cited

U.S. PATENT DOCUMENTS 3,090,302 5/1963 Johnson ..... 101/232

FOREIGN PATENT DOCUMENTS 23567 2/1981 European Pat. Off. ..... 101/328

*Primary Examiner*—Clifford D. Crowder

*Attorney, Agent, or Firm*—Robert S. Smith

[57] ABSTRACT

The information carrier is periodically applied to a platen which is preferably rotatable. The apparatus comprises in known manner a rotary stamp for printing information on the information carrier when this carrier moves between the platen and the stamp. The platen has at least one groove with two edges and a bottom situated between planes which bound at least an annular stamp surface carrying the printing faces, a part of the periphery of the stamp extends into the groove without touching the edges, and reset means urging the stamp and the platen towards each other. In accordance with the invention the inking device is arranged in the groove, said reset means urging the periphery of the stamp against the inking device in the absence of an information carrier.

The invention is employed in cheque readers and stamping machines.

11 Claims, 8 Drawing Figures

PRINTER WITH INKER ON THE PLATEN ROLLER

The invention relates to apparatus for printing information on an information carrier which lies against a platen. The apparatus comprises a rotary stamp for printing on the information carrier as it moves between the platen and the stamp. The stamp receives its ink from an inking device, information is printed on the carrier by a rolling movement of the stamp on the carrier. The platen is formed with at least one groove having two edges and a bottom. The groove is situated between planes which bound at least one annular stamp surface carrying the printing faces, a part of the stamp periphery carrying the printing faces on the annular surface extends into the groove without touching the edges at least in the absence of an information carrier, and there are provided reset means which act between the spindle of the stamp and that of the platen to move the stamp and the groove towards each other.

The invention is concerned with office automation, in particular information processing, for example automated document processing, specifically of commercial documents such as cheques, bills for exchange, order forms, bills to be protested, etc.

Equipment intended for this purpose, such as check readers or stamping machines, become more and more sophisticated and compact.

For example, when processing a check it is frequently necessary to write information on the face of the check at a specific location. When a rotary ink stamp is used for this purpose it is necessary to synchronize the movement of the check and the rotation of the stamp which is applied to the check which is backed by a rotary platen, in particular a rotating drum. Moreover, after the desired information has been printed on the check care must be taken that during the next revolution the stamp does not print the same information at another undersired location on the check or on the drum itself after the passage of the check, so that the next check would be stained.

It is the object of the invention to provide a cheaper solution, using a more compact construction, to a technical problem similar to that described in the foregoing paragraph in order to achieve stamping of information carriers with less restrains than indicated in the foregoing. In specific cases, in particular when a stamp is to be applied to the back of the check (the face of the check then being applied to the drum), information may be printed over the entire length of the check without the necessity of synchronizing the movement of the check and the rotation of the stamp. The information need not be printed at a precise location on the check and the printed information may be repeated after each revolution of the stamp. Moreover, this does not solve the problem of precluding that ink is applied to the drum after the passage of the check and the next check is stained by the drum itself. In order to solve the last-mentioned problem it is known from U.S. Pat. No. 3,090,302 to form the platen with a groove having two edges and a bottom, such that, at least in the absence of an information carrier, a part of the periphery of the stamp extends into the groove without touching the edges. However, such an apparatus remains rather bulky and expensive because it employs an inking device, which is separated from the stamp and the platen.

According to the invention, the last-mentioned drawbacks are precluded by an information-printing apparatus as defined in the opening paragraph, which is characterized in that the bottom of the groove carries the inking device, said reset means urging the stamp and the bottom of the groove towards each other in the absence of an information carrier.

When the leading edge of the check, as it is advanced, reaches the stamp, the part of said edge which covers the groove comes into contact with the stamp and lifts it slightly, during which the surface of the check may be curved slightly at the location where the stamp rests against the check, i.e. at the area to be printed, after which the stamp is rotated, which may be caused by the friction exerted on the check by the periphery of the stamp. Before the stamp and the check contact each other the stamp generally rotates already, which is desirable in order to ensure a correct linking of the printing faces and also in order to preclude shifting during the transient condition when the stamp comes into contact with the check.

One embodiment of the invention is characterized in that the inking device comprises an ink pad arranged on the bottom of said groove.

In an embodiment which is compatible with the last-mentioned embodiment the platen comprises two parts which are secured to each other at the location of the groove, the ink pad, which takes the form of a ring, being slid onto the bottom of the groove before the parts of the platen are secured to each other.

Embodiments of the invention will now be described in more detail, by way of example, with reference to the drawings.

FIGS. 1*a* and 1*b* illustrate the prior art, partly in a sectional view.

FIGS. 2*a* and 2*b* are an elevation and a plan view, respectively, of a version of the reset means which act for example on the spindle of the stamp.

Figure 6:
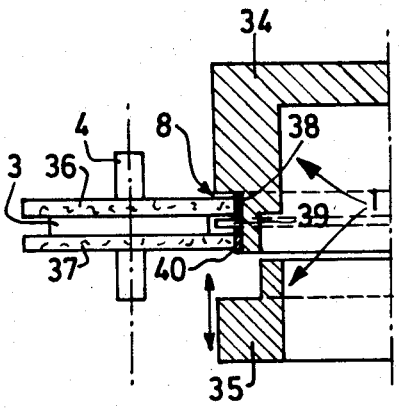

FIG. 6, partly in sectional view and partly broken away, shows a possible version of the rotary platen, intended for simultaneously printing a plurality of text lines.

Figure 1A:
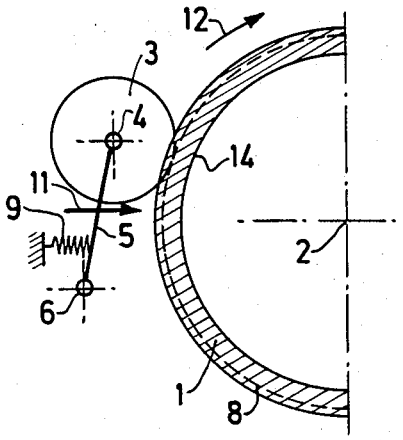
FIG.1a PRIOR ART
Figure 1B:
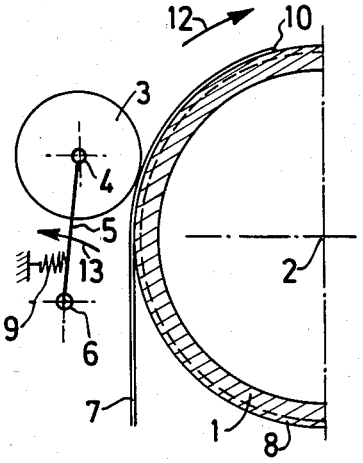
FIG.1b PRIOR ART
Figure 2A:
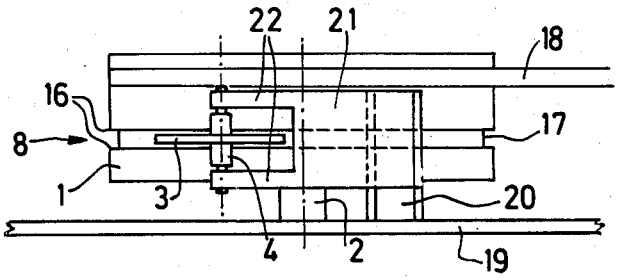
Figure 2B:
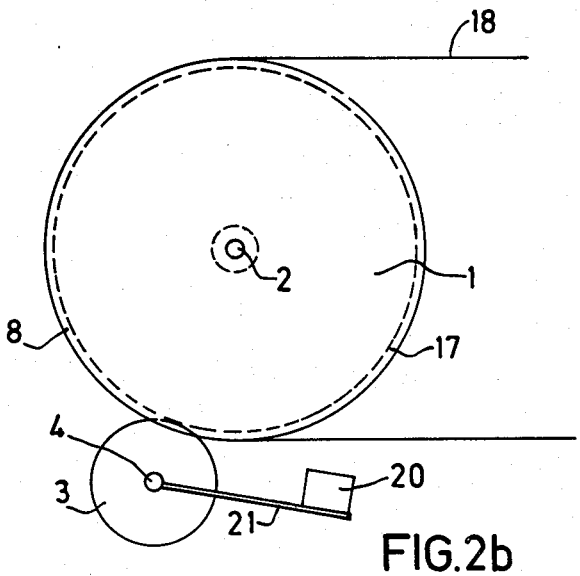

FIGS. 1*a* and 1*b* are sectional views of an information-printing apparatus, which comprises a platen 1 which is rotatable about an axis 2, and of which only the lefthand part is shown, and a stamp 3 comprising a circular disk. The stamp 3 has a spindle 4 which is mounted for rotation by means of an arm 5 whose other end is pivotable about a spindle 6. The stamp 3 is inked by known means, not shown. The spindles 2 and 6 are supported by a base plate, not shown, which extends parallel to the plane of drawing. The platen 1, which is rotated by known means, preferably by a belt (not shown) arranged over a part of its periphery, serves mainly for transferring an information-carrying document, for example a commercial document, such as 7 in FIG. 1*b*, while allowing information to be printed on it by known methods, in particular by means of the ink stamp 3. The platen 1 may comprise the main document-transport drum or a simple roller disposed along the document path. In particular if the space available around the main drum is small and/or if printing on the back of the document is required when the main drum the groove 8. The stamp 3 comprises, for example, two circular discs, the upper disc 36 and the lower disc 37. The platen which has two grooves with inking rings on the bottoms of the grooves is assembled as follows: when the two parts 34 and 35 are still separated a first inking ring 38 is placed on the bottom of the groove and pushed upwards until it is located near the upper edge of the groove, subsequently a metal washer 39 is fitted until it touches the ring 38, the inner diameter of this washer being equal to the diameter at the bottom of the groove and its outer diameter being equal to that of the platen. This operation is repeated for the inking ring 40. Since sliding means are present between the parts 34 and 35, the part 35 is slid into the part 34 until the inking ring 38 is situated near the lower edge of the groove. The parts 34 and 35 may be connected to each other by any known means, not shown, for example, be screwing one part to the other or by sliding one part into the other, after which they are secured by a bayonet coupling or by means of screws provided for this purpose.

Figure 3:
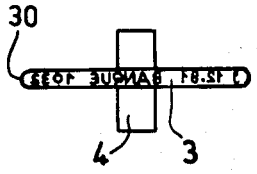
FIG. 3 is an elevation of a version of the stamp.
Figure 4:
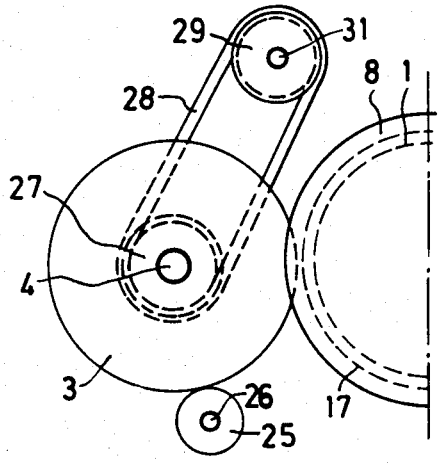
FIG. 4 is a plan view, partly broken away, of drive means for the stamp.
Figure 5:
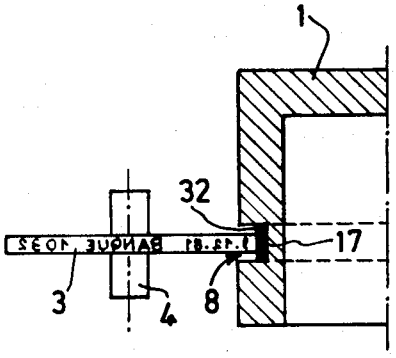
FIG. 5 shows an embodiment of the invention partly in sectional view and partly broken away.

The invention is not limited to the examples described in the foregoing. During its passage between the stamp and the platen the information carrier does not necessarily revolve around the platen. On the other hand, for the embodiments described in the foregoing with reference to FIGS. 3, 5 and 6 the movement impressed on the assembly of elements such as the platen, the stamp, the information carrier and as the case may be the inking pad, can be obtained by driving any of these elements or by driving a combination of two of these elements, because these elements engage frictionally with each other without slipping. The platen need neither be circular nor rotatable by may, for example, be flat, and it may be driven with a translational movement for printing information on the information carrier. In the last-mentioned case the groove has for example the shape of a rectangular parallelepiped. Moreover, the invention is not limited to check readers or to stamping machines and may be employed in, for example, printing machines in general or in labelling machines.

What is claimed is:

1. Apparatus for printing information on an associated information carrier which comprises a platen for carrying the information carrier, a rotary stamp for printing on the information carrier, means mounting said rotary stamp to move said record carrier between said platen and said stamp, means for delivering ink from an inking device to said stamp, said stamp printing information on said carrier by the rolling movement of said stamp on said information carrier, said platen having at least one groove having two edges and a bottom, said groove being situated between planes which bound at least one circular stamp surface carrying the printing faces, a part of the stamp periphery, carrying the printing faces on said circular surface, extending into said groove without touching the edges thereof at least in the absence of an information carrier, the apparatus further including a spindle mounting said stamp and a spindle mounting said platen, and reset means which act between said spindle of said stamp and said spindle of said platen to move said stamp and said groove towards each other, the bottom of said groove carrying said inking device, and said reset means urging the stamp and the bottom of the groove towards each other in the absence of an information carrier.

2. Apparatus as claimed in claim 1, wherein said inking device comprises an ink pad arranged on the bottom of said groove.

3. Apparatus as claimed in claim 2, wherein said platen comprises two parts which are secured to each other at the location of said groove, said ink pad which takes the form of a ring being slid into the bottom of said groove before said parts of said platen are secured to each other.

4. Apparatus as claimed in claim 1, 2, or 3, including a first pulley for driving said stamp, said first pulley being coaxial with and rotates with said stamp, said apparatus including a belt driving said first pulley and a second pulley whose rotary movement is caused by rotary movement of said platen in such a way that the circumferential speed of said platen and that of an annular surface of said stamp are substantially equal.

5. Apparatus as claimed in claim 1, 2, or 3, which comprises a stamp for printing a plurality of superimposed text lines, wherein a groove is formed opposite the surface of each text line on said stamp.

6. Apparatus as claimed in claim 1, 2, or 3, which comprises a stamp for printing a plurality of superimposed text lines, wherein a groove is formed opposite the surface of each text line on said stamp.

7. Apparatus as claimed in claim 1, 2, or 3, characterized in that the type faces arranged on the periphery of the stamp have a profile which is curved in the vertical direction.

8. Apparatus as claimed in claim 4, characterized in that the type faces arranged on the periphery of the stamp have a profile which is curved in the vertical direction.

9. Apparatus as claimed in claim 5, characterized in that the type faces arranged on the periphery of the stamp have a profile which is curved in the vertical direction.

10. Apparatus as claimed in claim 6, characterized in that the type faces arranged on the periphery of the stamp have a profile which is curved in the vertical direction.

11. Apparatus as claimed in claim 7, characterized in that the type faces arranged on the periphery of the stamp have a profile which is curved in the vertical direction.

* * * * *